US008523413B2

(12) United States Patent
Schug

(10) Patent No.: US 8,523,413 B2
(45) **Date of Patent: *Sep. 3, 2013**

(54) LED COLLIMATOR ELEMENT FOR A VEHICLE HEADLIGHT WITH A LOW-BEAM FUNCTION

(75) Inventor: Josef Andreas Schug, Wuerselen (DE)

(73) Assignee: Koninklijke Philips N.V., Eindhoven (NL)

( * ) Notice: Subject to any disclaimer, the term of this patent is extended or adjusted under 35 U.S.C. 154(b) by 659 days.

This patent is subject to a terminal disclaimer.

(21) Appl. No.: 12/096,924

(22) PCT Filed: Dec. 4, 2006

(86) PCT No.: PCT/IB2006/054580

§ 371 (c)(1),
(2), (4) Date: Jun. 11, 2008

(87) PCT Pub. No.: WO2007/069123

PCT Pub. Date: Jun. 21, 2007

(65) Prior Publication Data

US 2008/0285295 A1 Nov. 20, 2008

(30) Foreign Application Priority Data

Dec. 12, 2005 (EP) ..... 05111964

(51) Int. Cl.
*F21V 11/00* (2006.01)

(52) U.S. Cl.
USPC ..... 362/510; 362/296.1; 362/296.01; 362/300; 362/301; 362/303; 362/307; 362/311.01; 362/311.02; 362/487; 362/499; 362/509; 362/511; 362/514; 359/641; 315/77; 315/82

(58) Field of Classification Search
USPC ..... 362/487, 499, 507, 509–511, 514, 362/296.01, 298, 300, 301, 303, 307, 296.05, 362/296.1, 311.01, 311.02; 359/641; 315/77, 315/82
See application file for complete search history.

(56) References Cited

U.S. PATENT DOCUMENTS 1,445,306 A * 2/1923 Epstein ..... 362/301
1,478,564 A * 12/1923 Hallett ..... 362/301

(Continued)

FOREIGN PATENT DOCUMENTS

DE 2800797 7/1978
DE 8909067 11/1989

(Continued)

*Primary Examiner* — Mary McManmon

(57) ABSTRACT

The invention relates to a LED collimator element for a vehicle headlight with a low-beam function, which emits at least visible light of one color from at least one region of a light source. The LED collimator element (1) has at least one LED (2) as such a light source, whose predominant part of the light radiated in operation can be directly radiated in a radiation angular range of the LED collimator element (1), and comprises a collimator (3) deflecting the light which is not radiated in the radiation angular range of the LED collimator element (1) into the radiation angular range, wherein the LED collimator element (1) is asymmetrically structured at least regarding a collimator cutting plane (4) in such a way that a defined non-uniform brightness distribution is achievable in a radiation plane of the LED collimator element (1) defined orthogonally with respect to the collimator cutting plane (4) and with respect to a main direction of radiation of the LED collimator element (1), and at least one filter (12) is to be arranged at least in one region of the collimator (3) in such a way that, when realizing the low-beam function, the area of the traffic space, which lies below the bright-dark cut-off can be illuminated in defined areas with visible light of different colors.

20 Claims, 10 Drawing Sheets

(56) References Cited

U.S. PATENT DOCUMENTS

Figure 1:
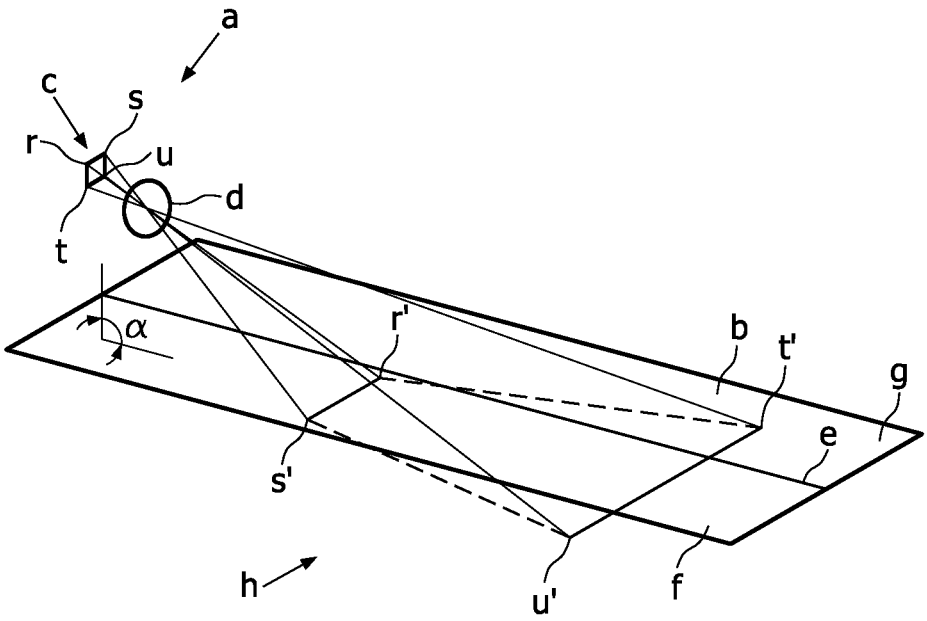

| | | | | |
|---|---|---|---|---|
| 1,583,216 | A * | 5/1926 | Wompey | 362/302 |
| 1,603,253 | A * | 10/1926 | Appel | 362/300 |
| 3,083,294 | A * | 3/1963 | Lindberg et al. | 362/464 |
| 4,580,197 | A * | 4/1986 | Lum | 362/85 |
| 5,136,483 | A | 8/1992 | Schoniger et al. | |
| 5,762,414 | A | 6/1998 | Montalan et al. | |
| 6,481,130 | B1 | 11/2002 | Wu | |
| 6,502,956 | B1 | 1/2003 | Wu | |
| 6,676,282 | B2 | 1/2004 | Begemann et al. | |
| 7,073,931 | B2 | 7/2006 | Ishida | |
| 7,670,038 | B2 | 3/2010 | Schug et al. | |
| 2003/0019806 | A1 | 1/2003 | Crudele | |
| 2003/0185005 | A1 | 10/2003 | Sommers et al. | |
| 2003/0198060 | A1 | 10/2003 | Ishida et al. | |
| 2003/0214815 | A1 | 11/2003 | Ishida et al. | |
| 2004/0042212 | A1 | 3/2004 | Du et al. | |
| 2004/0076016 | A1 | 4/2004 | Sato et al. | |
| 2005/0057917 | A1 | 3/2005 | Yatsuda et al. | |
| 2005/0243570 | A1* | 11/2005 | Chaves et al. | 362/551 |

FOREIGN PATENT DOCUMENTS

| | | | |
|---|---|---|---|
| DE | 19736837 | A1 | 2/1999 |
| DE | 10006804 | | 8/2001 |
| DE | 20116022 | | 1/2002 |
| DE | 10037005 | | 2/2002 |
| DE | 10140692 | | 3/2003 |
| DE | 10302969 | A1 | 8/2004 |
| EP | 1371901 | A2 | 12/2003 |
| FR | 1436821 | | 4/1966 |
| GB | 476745 | | 12/1937 |
| GB | 1594553 | | 7/1981 |
| GB | 2406900 | A | 4/2005 |
| JP | 61113290 | | 5/1986 |
| JP | 5274901 | A | 10/1993 |
| JP | 8204239 | | 8/1996 |
| JP | 2001332104 | | 5/2000 |
| JP | 2002157904 | | 5/2002 |
| JP | 2005267998 | A | 9/2005 |
| WO | 9745674 | | 12/1997 |
| WO | 2004053924 | A2 | 6/2004 |
| WO | 2006033042 | A1 | 3/2006 |

* cited by examiner

LED COLLIMATOR ELEMENT FOR A VEHICLE HEADLIGHT WITH A LOW-BEAM FUNCTION

The invention relates to a LED collimator element for a vehicle headlight with a low-beam function, which emits at least visible light of one color from at least one region of a light source.

Lamps for such vehicle headlights, which have hitherto been used in this field of application, are incandescent lamps, particularly halogen lamps having one or two filaments or high-pressure gas discharge lamps.

Generally, vehicle headlights generate light referred to as a high beam, on the one hand, and a low beam, on the other hand. The high beam provides maximal illumination of the traffic space. In contrast, the low beam constitutes a compromise between an optimal illumination from the perspective of the vehicle steering wheel and a minimal glare of oncoming vehicles. A lighting pattern is specified for the low beam, with which there is no incident light radiation in a radiation plane of the headlight above a horizontal line, i.e. the headlight should form a sharp bright-dark cut-off, so that under normal conditions the oncoming traffic on a straight road is not dazzled. However, as the headlight is supposed to illuminate the traffic space that is at the largest distance from the vehicle with the region directly below the bright-dark cut-off, the highest intensity of the headlight should be directly available at the bright-dark cut-off.

In the context of the invention, vehicle headlights with a low-beam function are all headlights that generate a bright-dark cut-off such as, for example, pure low-beam headlights, combined high and low-beam headlights, pure fog headlights, combined low-beam and fog headlights as well as curve illumination headlights.

It is known that bluish light is better reflected against obstacles in the traffic space, for example, traffic signs, and can thus be better or earlier observed in particular by the driver of the vehicle illuminating the respective traffic space, so that this can regularly enhance traffic safety. Yellowish light, by contrast, leads to lower glare sensitivity on the part of a driver of the oncoming vehicle. Hence, the color of the light above the bright-dark cut-off is also important. This light is often denoted as stray light, as it predominantly comprises uncontrolled scattered rays of light. Particularly for an application as an automobile headlight, two substantial characteristics of a lighting mechanism are thus necessary: on the one hand, the illumination source should be able to illuminate with high intensity an area approximately at a distance of 75 m from the illumination source, on the other hand, it should form a sharp bright-dark cut-off between the well-illuminated space and the unlighted region behind it, i.e. it should be able to generate a defined non-uniformly distributed illuminating radiation. In the direction of the road area, which is nearer to the vehicle, light having a lesser intensity is to be radiated. Due to the shorter distance from the headlight, a too high illumination would otherwise be generated there. A sufficient intensity in the well-illuminated area is in direct proportion to the brightness of the illumination source and the efficiency of the cooperating optics. However, generating a defined non-uniformly distributed illumination radiation, particularly a sharp bright-dark cut-off, is a design challenge.

Although, in principle, a clear separation into a bright zone with a good illumination of the road and a dark zone above it with minimal glare of the oncoming traffic is desired, it has to be taken into account that some illumination is also necessary in the dark zone, in order to recognize, for example, road signs or back reflectors of vehicles driving ahead, or road limitation posts. Moreover, a too strong contrast is unpleasant for the driver, as e.g. objects and marks in the field of view then appear very suddenly. For the oncoming traffic, a sharp bright-dark cut-off is unpleasant when the eyes are suddenly struck by the full intensity in the case of unavoidable road unevenness or curves. Here, a soft bright-dark cut-off can moderate the effect to some extent.

One possibility of softening the bright-dark cut-off is the fuzzy image of the diaphragm in projection systems. Such a fuzzy image could also be used in headlight systems, which use the LED collimator elements. However, in this method, unwanted color fringes, which are difficult to control, often result along the bright-dark cut-off in projection headlight systems.

A lamp for a vehicle headlight with a low-beam function is known from WO 2004/053924 A2, which lamp has an outer envelope and emits at least visible light of different colors from a plurality of regions of the outer envelope. At least a partial coating is provided on this outer envelope such that, when the low-beam function is being realized, at least that area of the traffic space which lies above the bright-dark cut-off can be at least partly illuminated with visible colored light which is scattered at the partial coating, while at the same time that area of the traffic space which lies below the bright-dark cut-off can be illuminated with visible light of a different color in defined areas. This remedy refers to lamps such as incandescent lamps, particularly halogen lamps, with one or two filaments, or high-pressure gas discharge lamps.

The design of LED elements has led to the fact that LED elements that have a sufficient brightness in order to be used, for example, as headlights with a low-beam function for automobiles will be available in the near future.

In lamp systems using LEDs, one tries to solve the problem of intensity, inter alia, by arranging a plurality of LEDs and by superposing their illumination image. Such an arrangement is known from US 2003/0198060 A1. According to this document, a plurality of LEDs is arranged next to each other, which is easily possible because of their small space requirement and which leads to new designs of automobile headlights. A reflector is arranged over each individual LED, which reflector deflects the light emitted by the LED essentially right-angled in a direction of radiation. Together with a light-guiding edge, which is arranged in the direction of radiation behind the LED, the reflector generates an illumination image with a sharp bright-dark cut-off, which is superposed with the other illumination images by means of a projection lens and imaged in the traffic space. This construction has the drawback that substantially the entire radiation emitted by the LED is reflected at least once before it reaches the secondary optical system. However, each reflection also adds up to a certain loss of luminous efficiency, thus decreasing the power of this lighting system.

There is a need for lamps, particularly using LEDs, which, while realizing the low-beam function, illuminate the traffic space below the bright-dark cut-off in a defined multi-colored way and achieve a good illumination directly below the bright-dark cut-off.

It is an object of the invention to provide a LED collimator element as well as an illumination unit with such a LED collimator element, which can be efficiently manufactured in an industrial mass-manufacturing process, which, by realizing the low-beam function, illuminates at least the traffic space below the bright-dark cut-off in a defined multi-colored way and achieves a good illumination directly below the bright-dark cut-off and thus allows an increase in road safety.

The object of the invention is achieved by the characteristic features of claim 1.

It is an essential aspect of the invention that the LED collimator element has at least one LED as such a light source, whose predominant part of the light radiated in operation can be directly radiated in a radiation angular range of the LED collimator element, and comprises a collimator deflecting the light which is not radiated in the radiation angular range of the LED collimator element into the radiation angular range, wherein the LED collimator element is asymmetrically structured at least regarding a collimator cutting plane in such a way that a defined non-uniform brightness distribution is achievable in a radiation plane of the LED collimator element defined orthogonally with respect to the collimator cutting plane and with respect to a main direction of radiation of the LED collimator element, and at least one filter is to be arranged at least in one region of the collimator in such a way that, when realizing the low-beam function, the area of the traffic space which lies below the bright-dark cut-off can be illuminated in defined areas with visible light of different colors.

In this case, the LED collimator element is asymmetrically structured at least regarding a collimator cutting plane in such a way that a defined non-uniform brightness distribution is achieved in a radiation plane of the LED collimator element defined orthogonally with respect to the collimator cutting plane and with respect to a main direction of radiation of the LED collimator element.

The radiation angular range is the angular range in which the light from the collimator is radiated so as to generate the desired directed lighting. The relevant radiation angular range is essentially the detection region of the secondary optical system. The direction of radiation within the radiation angular range, in which the largest part of the light is radiated, is to be understood as the main direction of radiation of the LED collimator element. The collimator cutting plane is situated in the main direction of radiation of the LED collimator element and also cuts the LED element. The radiation plane substantially extends orthogonally to the collimator cutting plane through the LED collimator element and is generally parallel to a light entrance angle of a secondary optical system. It represents a geometrical area which, as a rule, coincides with an aperture of the collimator.

A "collimator" is understood to mean a reflecting surface, which substantially detects the whole light of the LED element, not directly radiated in the radiation angular range. In contrast to a reflector, the collimator is directly contiguous with the LED chip. In order to take tolerances into account during manufacture of the LED chip, the collimator can be situated at a small distance from the LED, which may be, for example, approximately 0.5 mm, preferably even below it.

A "non-uniform brightness distribution" is understood to mean a brightness distribution in the radiation plane, with different brightness levels in different areas.

In the context of this invention, a "filter" or "filter element" is understood to mean an optically active medium, which has different characteristics during the passage of light. These characteristics are particularly, but not exclusively, dependent on the wavelength of the respective ray of light. These filters may be particularly wavelength-dependent absorption, transmission or reflection filters. These can be designed in the form of thin layers (interference filters) or as volume filters. A filter can leave the direction of the ray of light essentially uninfluenced or more or less change it, for example, by scattering. Not only the spectral characteristics but also the scattering behavior can change via the surface or the volume of the filter.

The filters can be applied particularly on a transparent carrier or may be integrated therein, which carrier forms the end of the collimator and is situated in the collimator exit face or the collimator aperture. Translucent (scattering) filters, which are only partly illuminated, can be used particularly for generating soft bright-dark cut-offs.

One aspect of the invention turns aside this principle used in the aforementioned state of the art of deflecting the predominant part of the light radiated by the LED element in the radiation angular range of the collimator and follows instead the principle of essentially utilizing the light radiated by the LED element directly and leading it, for example, directly into a secondary optical system. This is based on the recognition that any deflection that must be realized by means of reflection leads to losses of luminous efficiency.

In the context of the invention, it is assumed that the LED elements are inorganic solid-state LEDs, because these are currently available with sufficient intensity. They may of course also be other electroluminescent elements, for example, laser diodes, other light-emitting semiconductor elements or organic LEDs, in so far as these have sufficient power values.

In the context of the invention, the term "LED" or "LED element" is therefore to be considered as a synonym for any type of corresponding electroluminescent element. A component of the LED element may also be a luminescent material in the form of a powder or a crystal, which converts a part of the generated light or the entire light into light having a different wavelength.

In countries having right-hand traffic, such as e.g. Germany, the LED collimator element, according to the invention, is to be selected and arranged in such a way that, in the driving direction of the vehicle, the right-hand side of the road or particularly its outermost region is illuminated with bluish light, whereas the left-hand side of the road is illuminated with yellowish light. The glare sensitivity of oncoming traffic is reduced, while at the same time an improved perceptibility of objects in the peripheral field of view of the right-hand side of the road is achieved. In a suitable modification of the invention, this is equally adaptable to left-hand traffic.

The dependent claims 2 to 10 define further embodiments of the invention; without representing these in a conclusive way.

When using LED collimator elements for illuminating the area of the headlight beam distribution, in which vehicles of the oncoming traffic are also likely to be present, it may be preferred, for example, that the area directly below the bright-dark cut-off and/or the stray light above it is yellowish-colored to some extent or has a reduced blue portion. This can be achieved, for example, by an absorption filter along the edge of high intensity, which filter absorbs blue light.

When LED collimator elements are applied in the peripheral region of the headlight beam, the color hue can be increased by using a blue interference filter along the edge of high intensity, which increase of the color hue is advantageous for recognizing the lateral road markings and for recognizing obstacles. The yellowish light reflected by interference filters is available after possible renewed reflection in the collimator in other beam regions or can contribute to the stray light so as to reduce the glare impression. Moreover, combinations are also conceivable.

When realizing the low-beam function, the traffic space below the bright-dark cut-off can be illuminated preferably in such a way that yellow light dominates in a first region, blue light dominates in a second region, and light which is not substantially affected by a filter dominates in a third region.

As described above, a sharp bright-dark cut-off, below which the intensity is as high as possible, is necessary, particularly for applications in vehicle headlights.

In an advantageous embodiment of the invention, the non-uniform brightness distribution is therefore designed in such a way that there is a high intensity directly at a first edge of the collimator, and that there is substantially no light intensity at the side of this edge of the collimator remote from the LED, so that a sharp bright-dark cut-off is generated without substantial parts of the radiation being faded out by glare or the like. In terms of luminous efficiency, the design thus functions substantially without losses.

According to the invention, the non-uniform brightness distribution is obtained in that the LED collimator element has an asymmetric structure.

The asymmetrical embodiment of the LED collimator element can be more preferably formed in such a way that the area of the collimator at which the first edge is formed is less inclined with respect to the main direction of radiation than the second area, so that the collimator generates a sharp bright-dark cut-off as described above. In a simple case, the first and the second edge of the collimator are situated at facing areas of the collimator, so that the light radiated by the LED element is radiated with a stronger concentration at the first edge than at the second edge.

In a combined variant of the above-mentioned design alternatives, a LED arranged obliquely with regard to the collimator cutting plane is arranged in an asymmetrically designed collimator.

The form of the collimator areas is then not limited to even areas and their combinations, but may be, for example, continuously curved in differently strong degrees, depending on the depth of the collimator.

If the bright-dark cut-off is to be designed to be softer, the use of scattering filter elements along the edge of the collimator is preferred. Then, the brightness does not decrease abruptly at the edge, but will decrease particularly slowly as the distance increases. Such an arrangement can also be used to provide a region having a very small but defined brightness in the region outside the actual collimator aperture, allowing a controlled realization of the intensity above the bright-dark cut-off in the headlight beam.

In accordance with a further advantageous embodiment of the invention, a secondary optical system is arranged behind the collimator aperture in the main direction of radiation, which system images the radiated light in the space to be illuminated. Generally, the secondary optical system may consist of a projection lens, which projects the illumination image generated by the LED collimator element onto the object to be illuminated. The lens may be a spherical or an aspherical lens, but cylindrical lenses having a focus setting in one direction only can also be used. Furthermore, rotationally symmetrical or plane parabolic reflectors or open-space reflectors can be considered as secondary optical systems. This enumeration is not exclusive in the context of the invention.

A plurality of LED elements having different characteristics, for example, a different luminous efficiency or a different color can be preferably combined in a collimator. In the case of simultaneous operation, an average result arises from mixing the light in the collimator. When manufacturing LEDS, a spread of the mentioned parameters around the nominal value usually develops. The combination of a plurality of LED elements in a collimator with, for example, too high and too low color temperature nevertheless allows light of the desired color to be generated and thus provides a more economic application of the entire manufacturing range. Moreover, the combination of LEDS having different color properties allows the color of the light generated by the collimator to be changed in a defined way by a non-uniform control of the respective elements.

Furthermore, the filter element can be utilized to determine the geometrical position of the bright-dark cut-off relative to the mechanical references of the housing of the LED collimator element with high accuracy. This may be useful when the LED with the collimator surfaces is pre-assembled as an intermediate unit because of the necessary accuracy, whereafter this unit is mounted in the collimator housing. Under circumstances, the accuracy of positioning the collimator exit aperture is then reduced. On the other hand, the filter element, which may also comprise a diaphragm, can be positioned independently with high accuracy above the collimator exit aperture.

The object of the invention is also achieved by an illumination unit having at least one LED collimator element according to the invention, as defined in claim 11.

These and other aspects of the invention are apparent from and will be elucidated with reference to the embodiments described hereinafter.

Figure 2A:
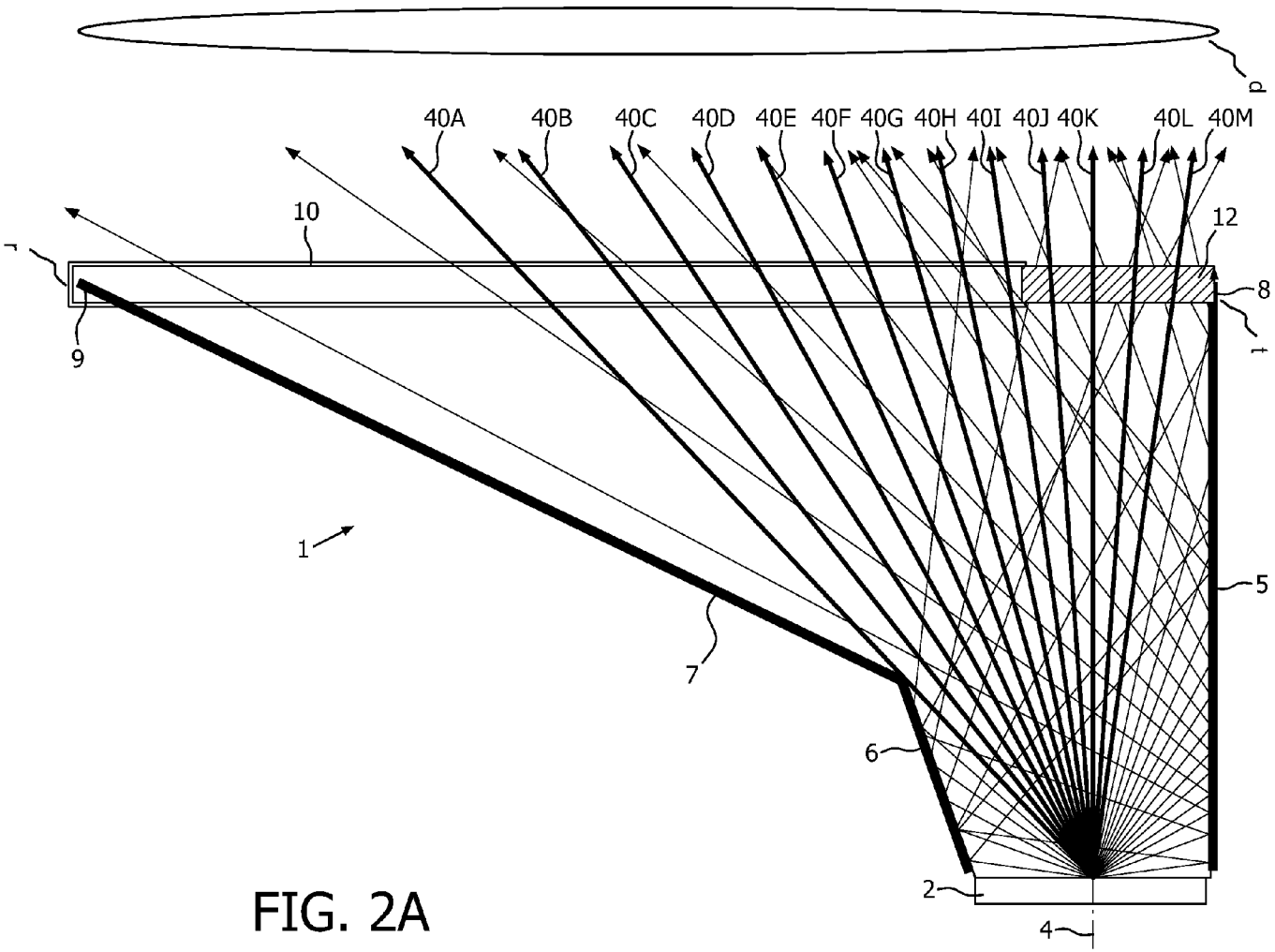
Figure 2B:
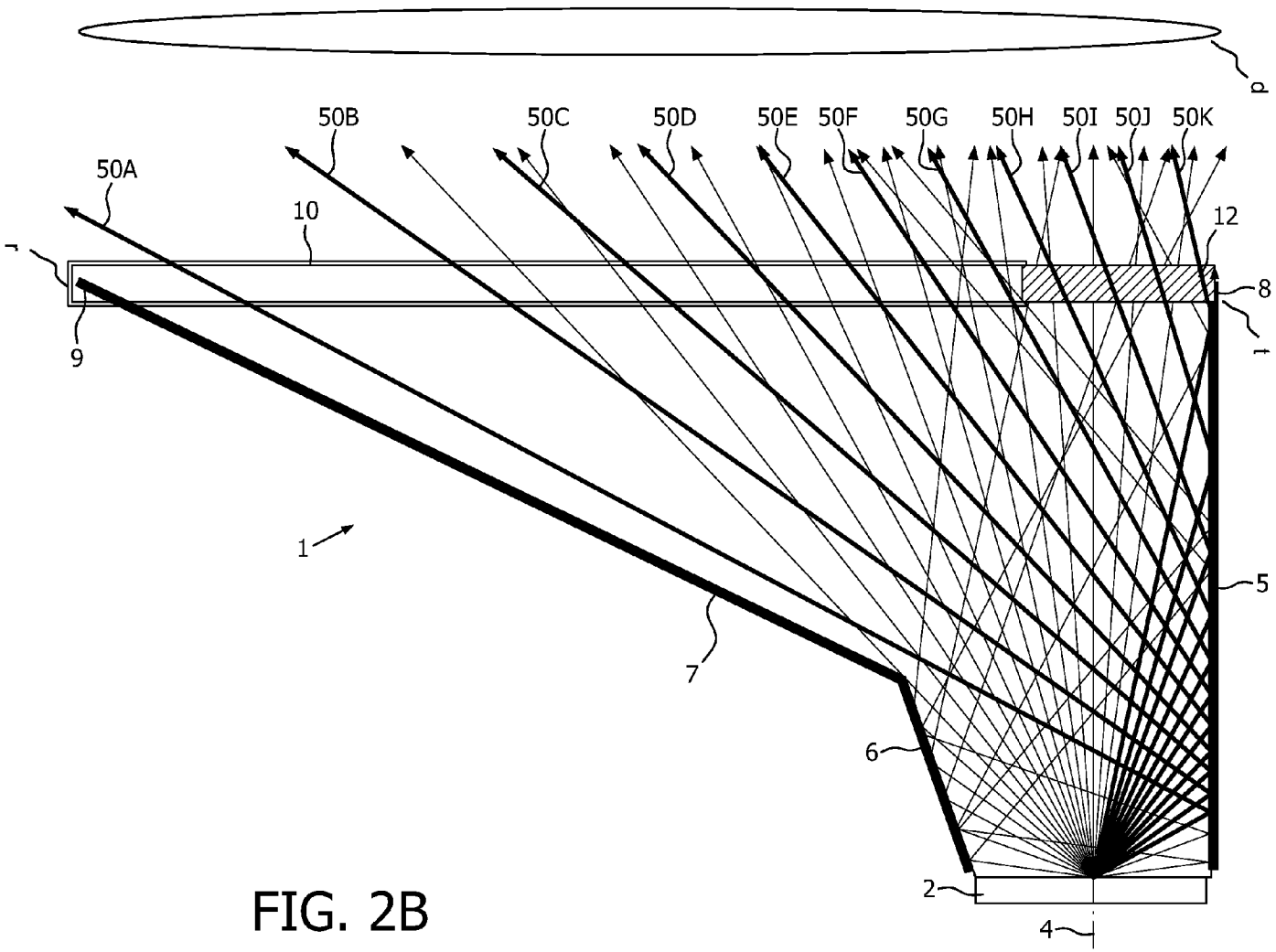
Figure 2C:
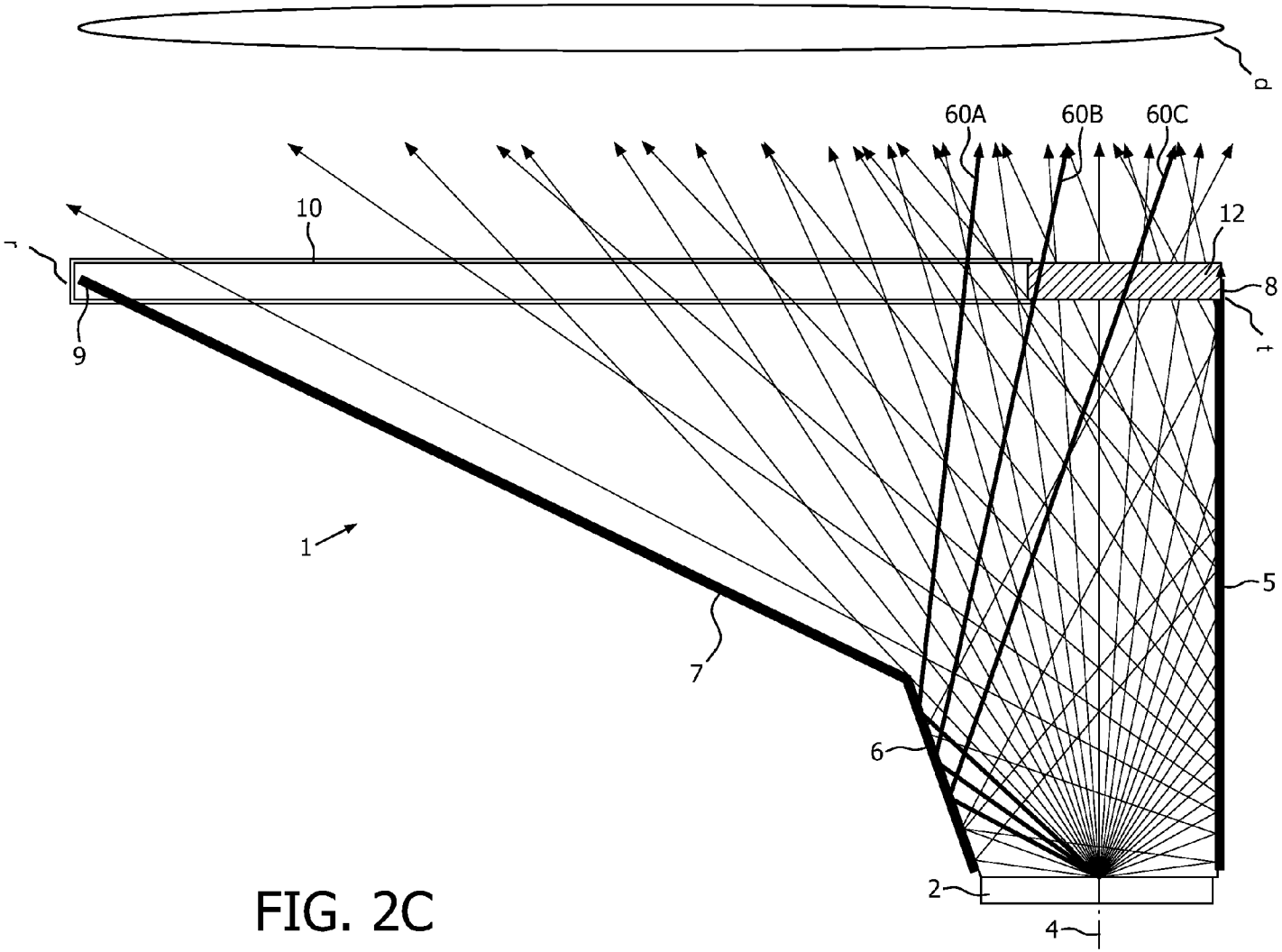
Figure 2D:
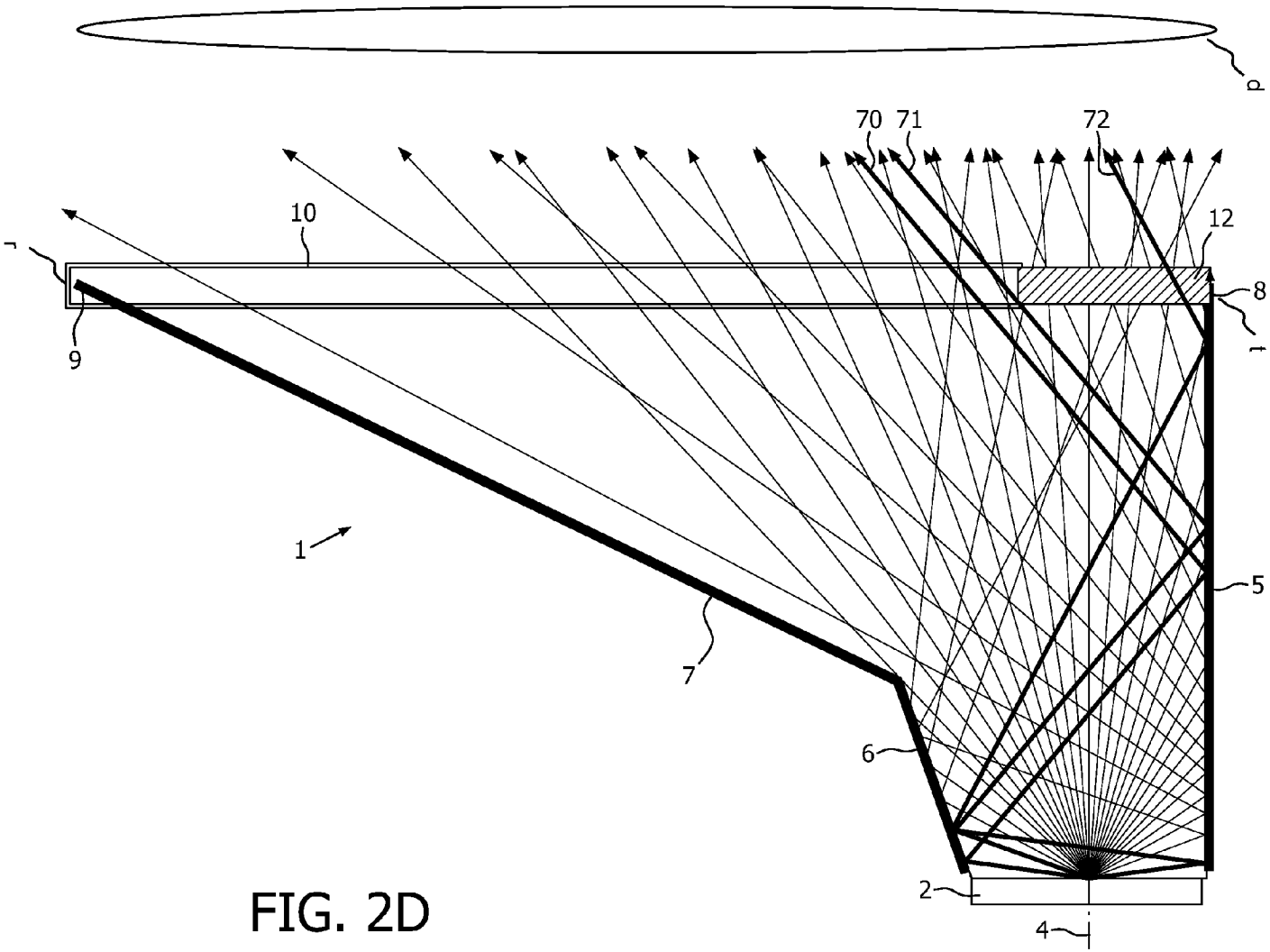
Figure 3:
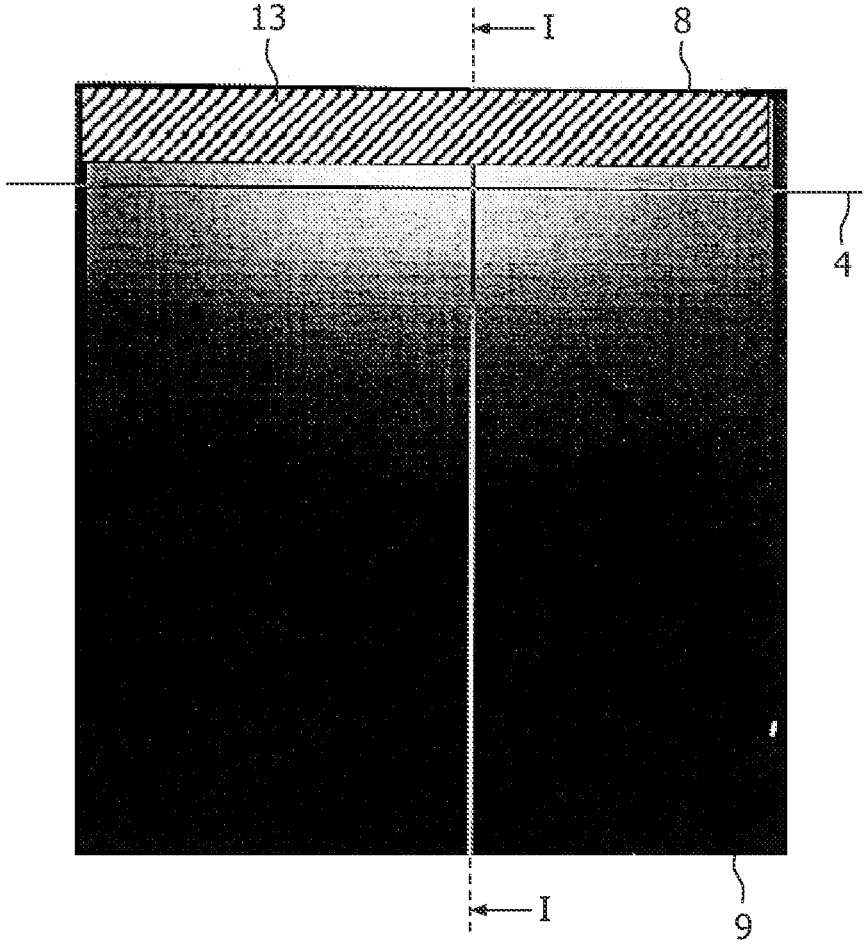
Figure 4:
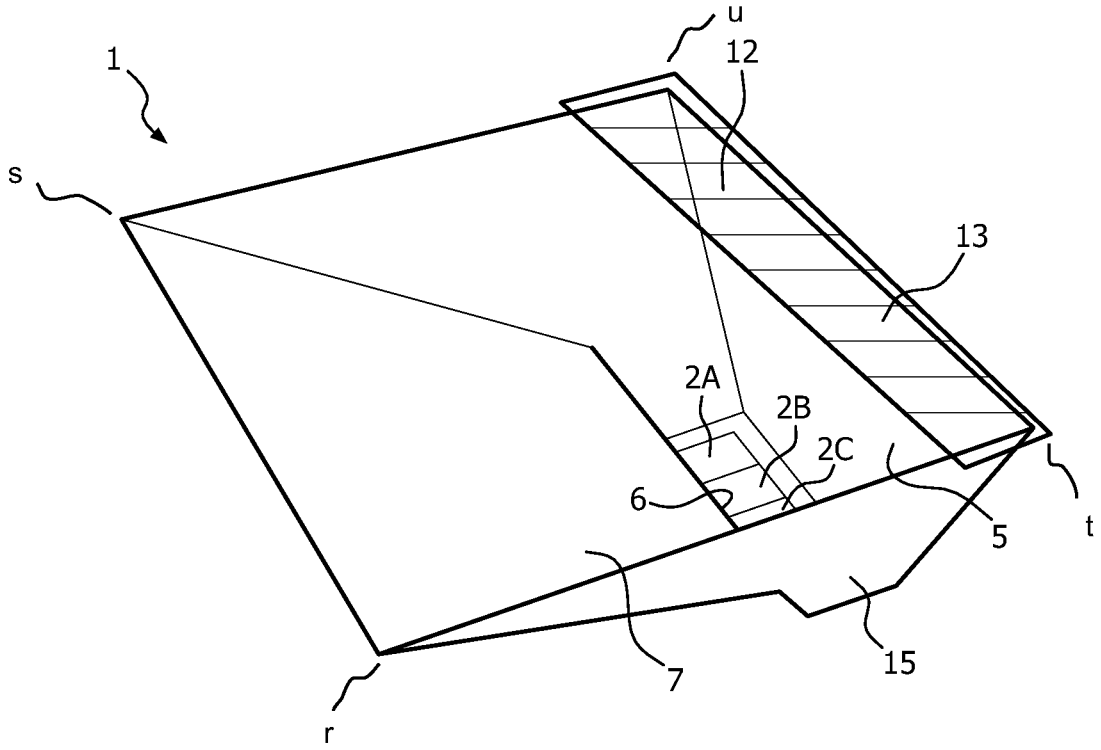
Figure 5:
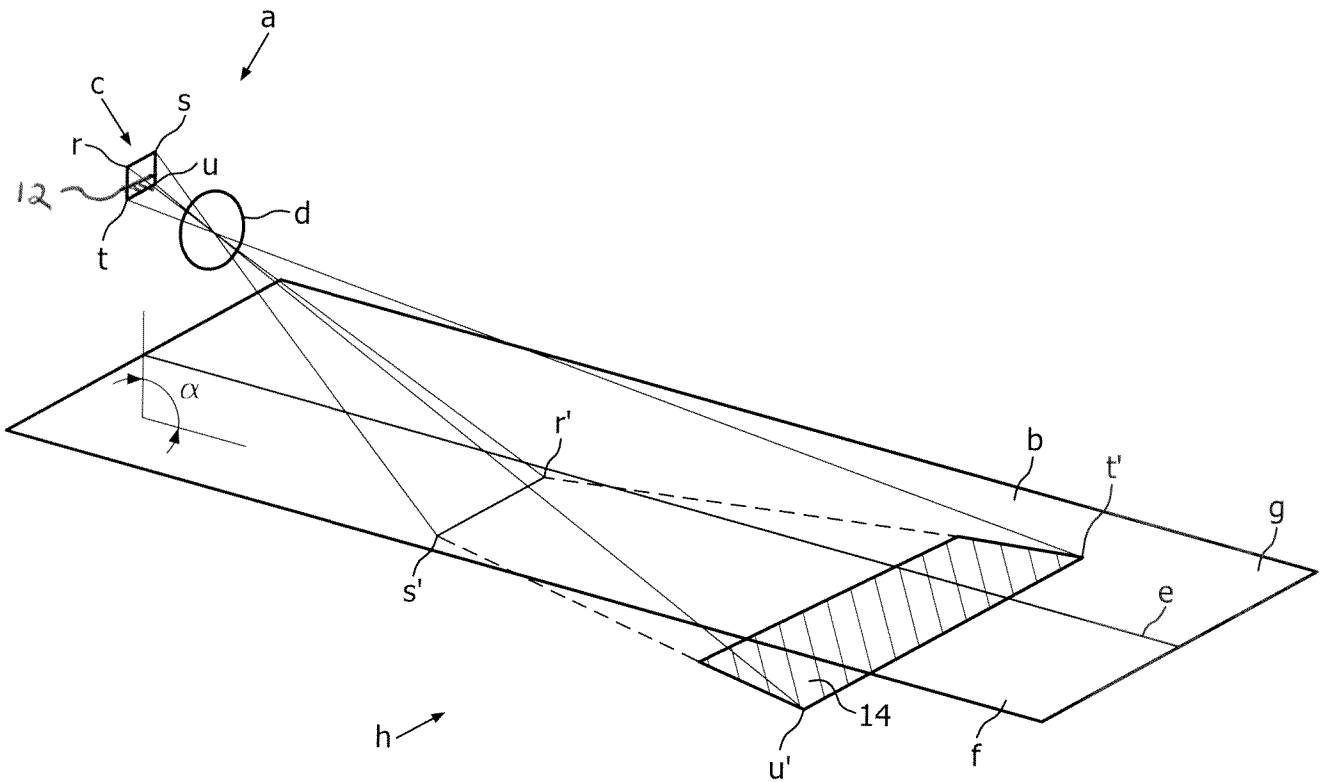
Figure 6:
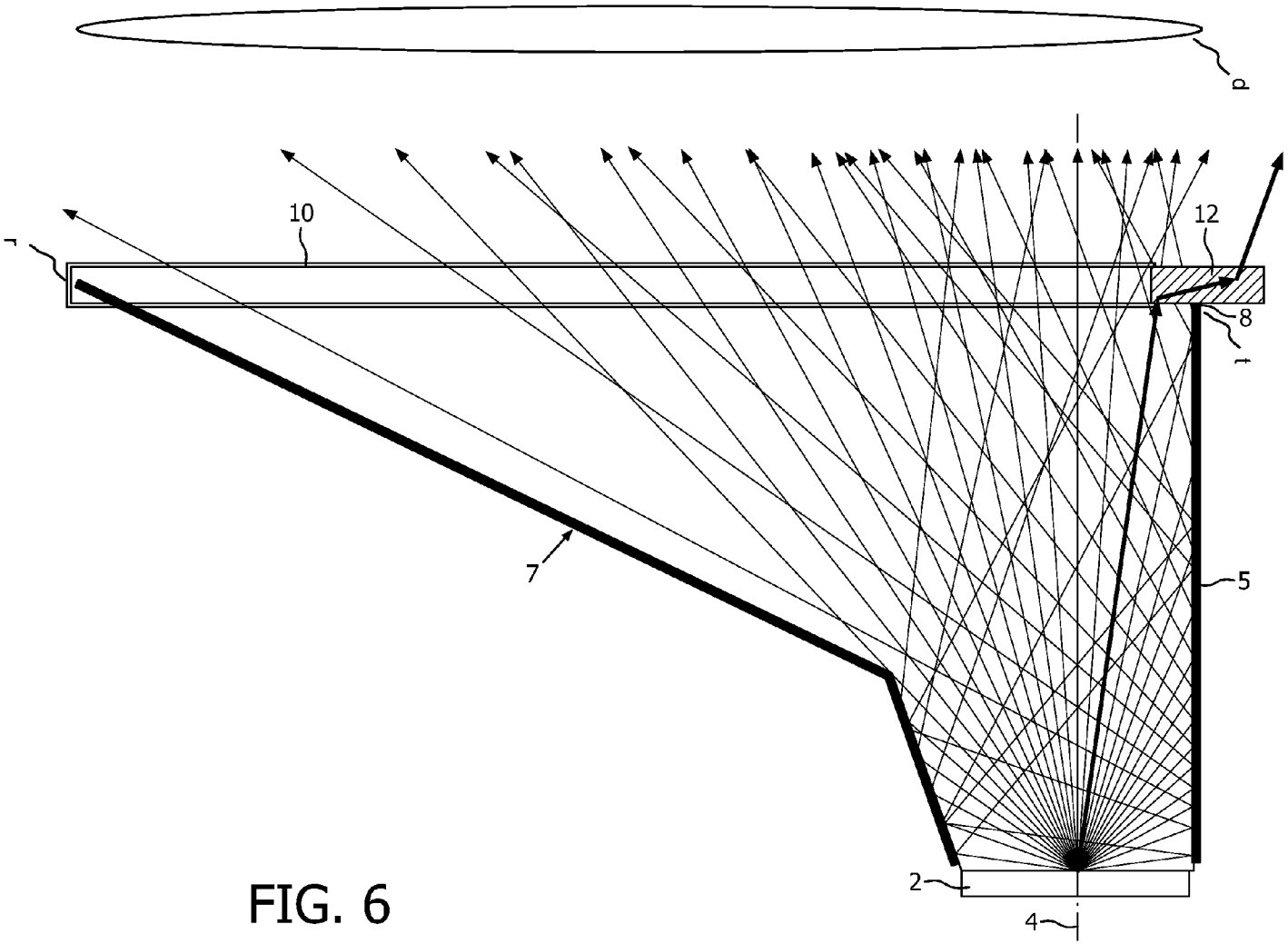
Figure 7:
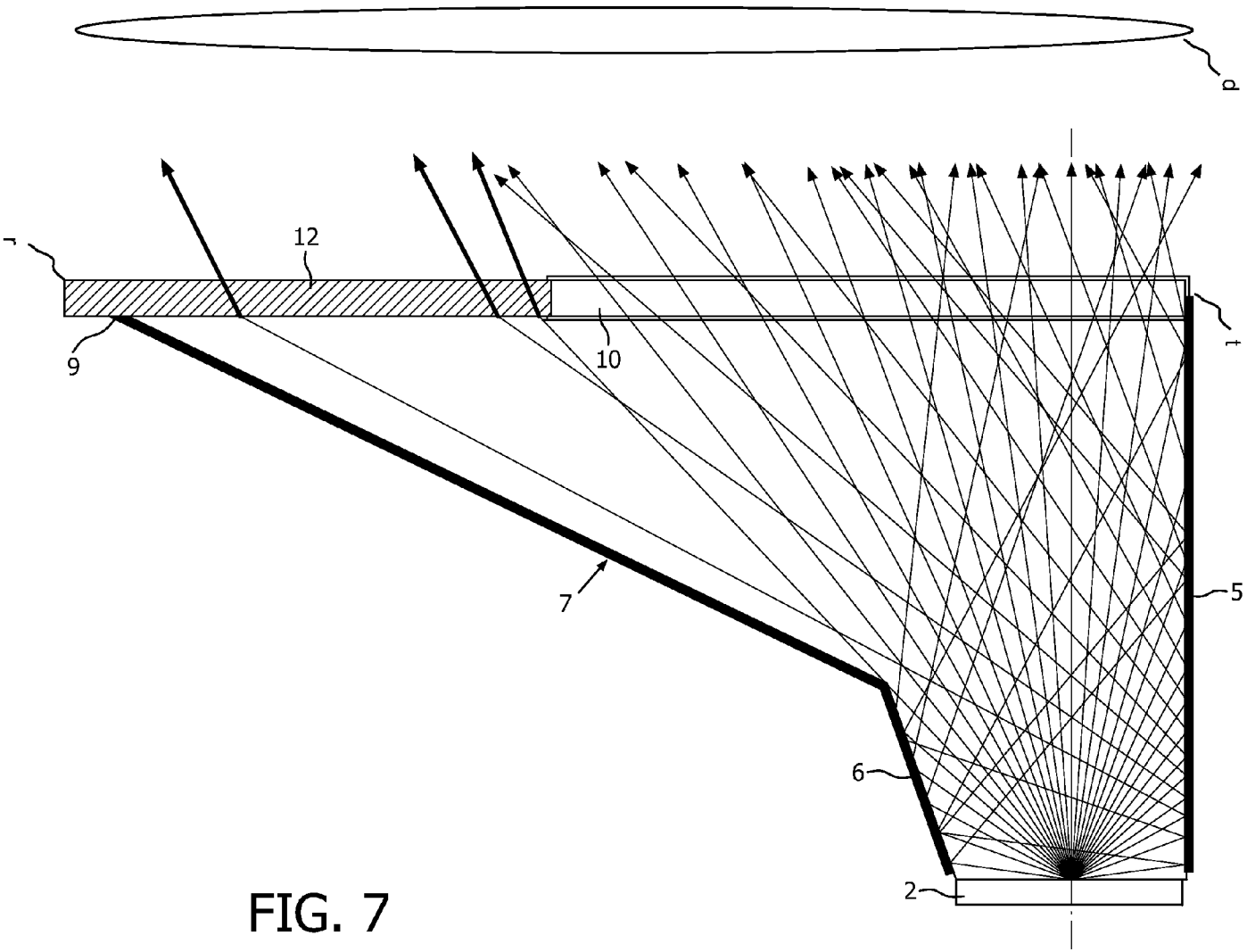

In the drawings:

FIG. 1 is a simplified perspective representation of the radiation paths of a headlight on a road, FIG. 2A is a section through a first embodiment of a LED collimator element according to the invention, FIG. 2B is a section through a first embodiment of a LED collimator element according to the invention, FIG. 2C is a section through a first embodiment of a LED collimator element according to the invention, FIG. 2D is a section through a first embodiment of a LED collimator element according to the invention, FIG. 3 shows an illumination image in the radiation plane of a LED collimator element, FIG. 4 is a perspective view of a LED collimator element as shown in FIG. 2, FIG. 5 is a simplified perspective representation of the radiation paths on a road of a headlight with a LED collimator element according to the invention, as shown in FIG. 2, FIG. 6 is a section through a second embodiment of a LED collimator element according to the invention, and FIG. 7 is a section through a third embodiment of a LED collimator element according to the invention.

FIG. 1 schematically elucidates the light radiation path of a headlight a on a road b. The headlight a is symbolized by a radiation surface c of a LED collimator element and by a secondary optical system d. The radiation surface c has four boundary lines between the corners r, s, t and u. The road b is divided into two lanes f and g by a median strip e. The vehicle (not shown), which has the headlight a, is in the lane f (right-hand traffic). The lane g is for the oncoming traffic. The headlight a illuminates a traffic space h where it generates an image having the corners r', s', t' and u'.

The light emanating from the radiation surface c is incident upon the secondary optical system d. It is generally formed by a lens, which images the radiation surface in a laterally and elevation-inverted way. As the radiation plane c is at an angle a to the road f, which is to be illuminated, its resulting image on the road is distorted. In spite of the same length of the distance from r to s or from t to u, the stretch t' to u' has a multiple length of the distance from r' to s'. This distortion is also to be taken into account in the illumination of the traffic space h. With an approximately uniform illumination of the traffic space h, it requires a much larger luminous power at the edge of the radiation plane between u and t than at the opposite edge between r and s. Ideally, a continuous transition or a luminance gradient is thus formed between a high luminous power at the edges u and t and a smaller luminous power at the edges r and s.

In order to avoid glare of the oncoming traffic, no more light should be radiated outside the image with the corners r', s', t' and u'. This particularly relates to the edge between t' and u'. Here, the light source must form a sharp bright-dark cut-off, because light above this edge would dazzle the oncoming traffic. Hence, the bright-dark cut-off must be formed at the radiation plane along the line t to u.

These requirements are converted as follows in the construction of a LED collimator according to the invention: A LED collimator 1 as shown in FIG. 2A comprises a LED element 2 and a filter 12 and at least one reflector area. The LED element 2 radiates collimated light in a main direction of radiation. The main direction of radiation runs parallel to a first collimator cutting plane 4. The main direction of radiation of the LED element 2 is defined here as the normal to the plane, in which the chip of the LED element 2 extends.

The LED collimator 1 has a first reflector area 5, which extends parallel to the first collimator cutting plane 4. Opposing reflector area 5, there is a second reflector area which is comprised of a lower section 6 and an upper section 7. In order to avoid losses, the distances of both reflector areas from the LED element 2 are smaller than the dimension of LED element 2. In the main direction of radiation, both sections 6, 7 have an inclination away from the collimator cutting plane 4. The lower section 6 is far less inclined to the collimator cutting plane 4 than the upper section 7. The first reflector area 5 and the upper section 7 terminate in a radiation surface 10 at a first edge 8 of the LED collimator 1 and a second, opposite edge 9 of the LED collimator 1. The radiation surface 10 is to be understood merely as a geometrical location, which in FIG. 1 coincides with the collimator aperture. The collimator aperture is spatially bounded by the edges 8, 9 as well as the edges of the two surfaces 15 (not shown). The two surfaces 15 may be parallel to the sectional view of the LED collimator shown in FIG. 2A and normal to first cutting plane 4. Both the main direction of radiation of the LED element 2 and the collimator cutting plane 4 are perpendicular to the radiation surface 10. The filter 12 is positioned near first edge 8, parallel to LED element 2. At least one edge of filter 12 terminates at first edge 8 of LED collimator 1. The outer surface of filter 12 may be a portion of radiation surface 10.

FIG. 2A elucidates the mode of operation of the asymmetrical LED collimator 1 in cooperation with a LED element 2. FIG. 2A shows a beam, by way of example, which beam is emitted by the LED element 2. Actually, however, the LED element 2 radiates light non-directionally throughout its width (Lambertian radiation). The radiation of the LED element 2 is symbolized by solid-line arrows which represent rays. The the rays 40A-40M particularly represent that radiation which is directly emitted from LED element 2.

FIG. 2B shows rays 50A-50K which are reflected once at the first reflector area 5 and leave the LED collimator 1. Since the first reflector area 5 runs parallel from the LED element 2 to the collimator cutting plane 4, it reflects a relatively large part of the radiated light into the space towards the edge 9 of the LED collimator 1. However a portion of the rays reflected from first reflector area 5, e.g. rays 50H, 50I, 50J and 50K leave LED collimator 1 near first edge 8 through filter 12.

FIG. 2C shows the lower section 6 extending from an edge of the LED element 2 with an inclination of up to approximately 45° away from the collimator cutting plane 4. Hence, it reflects a substantial part of that light which is radiated at a large angle to the main direction of radiation or the collimator cutting plane 4. However, due to its inclination, the lower section 6 reflects the radiation at a substantially flatter angle to the collimator cutting plane 4 than the reflector area 5. As a result, part of the light, e.g. rays 60A, 60B and 60C, reflected by the lower section 6 reaches the radiation surface 10 without further reflections. Due to the geometry of the section 6, this light is incident upon an area of the radiation surface 10 near the first edge 8, particularly in the region of the filter 12.

As the upper section 7 is inclined further from first cutting plane 4 than the lower section 6, no radiation coming from the LED element 2 is directly incident upon the upper section 7. Neither does upper section 7 contribute to the reflection of rays that have already been reflected once at. Therefore, it does not need to have a highly reflecting surface; it could in principle even be dispensed with.

FIG. 2D shows multiply reflected rays 70, 71 and 71. Ray 70 is reflected by lower section 6 and then reflector area 5. This ray is not incident upon an area of the radiation surface 10 near the first edge 8. Ray 71 is reflected from reflector area 5, then by lower section 6 and then a second time from reflector area 5. This ray is incident upon an area of the radiation surface 10 near the first edge 8. Ray 72 is reflected from reflector area 5, then by lower section 6 and exits radiation surface 10 towards the outside of first edge 8. All rays are attenuated upon each reflection as is well known in the art.

In the construction of LED collimator 1 described above, a major part of the radiation emitted by the LED element 2, through radiation surface 10, close to the first edge 8 so that the brightness distribution of the radiation has a progression with decreasing gradients from the first edge 8 to the second edge 9. On the outside of the first edge 8 facing away from the LED, there occurs only very slight stray radiation beyond the radiation surface 10, wherein a suitable choice and/or coupling of the secondary optical system can ensure that this stray radiation is not imaged above the bright-dark cut-off in the traffic space.

This results in an appearance or an illumination image in the radiation plane of a LED collimator element 1, as is shown in FIG. 3. From the upper edge 8 towards the lower edge 9, a decreasing illuminance is defined along each section parallel to the imaginary intersecting line 1-1. As almost no light is irradiated above the first edge 8, a maximally sharp bright-dark cut-off develops along the edge 8. The light, which comes from the radiation surface 13 of the filter 12 (shaded rectangular surface in FIG. 3), has a relevant color in accordance with the respective characteristic of the filter 12. Hence, the two most important characteristics of a lighting system are particularly given for automobile headlights, namely, on the one hand, a sharp bright-dark cut-off directly at the region of the highest lighting intensity and, on the other hand, a defined gradient in the brightness distribution from a high intensity at the bright-dark cut-off to a small intensity at the region facing the bright-dark cut-off.

FIG. 4 is a perspective view of a LED collimator element 1 according to the invention as shown in FIG. 2. This view primarily elucidates the allocation of the reflecting areas 5, 6, 7 or the two lateral reflector surfaces 15 to each other and to the LED elements 2A, 2B and 2C. Parallel to the plane of the drawing of FIG. 2, the LED collimator element 1 is limited by two lateral reflector surfaces 15. These lateral reflector surfaces 15 are inclined outwards, when viewed in the direction of radiation but may just as well extend at right angles to the plane of the LED element 2 and hence parallel to the collimator cutting plane 4 as shown in FIG. 2.

The LED element 2 covers a basically rectangular area, whose longest side extends parallel to the collimator cutting plane 4, shown in FIG. 2.

Instead of a basically rectangular LED element 2, as shown in FIG. 4, a plurality of, for example, square LED elements could alternatively be arranged next to each other, so that again a rectangular area would result.

The filter element 12 or its radiation surface 13, shown in FIG. 4 as a shaded area, is situated in an area of the collimator exit aperture, i.e. approximately parallel to the basically rectangular LED element 2.

FIG. 5 is a simplified perspective view of the radiation paths of a headlight with a LED collimator element according to the invention, on a road. FIG. 5 corresponds substantially to FIG. 1, wherein additionally the region on the road 14, shown in FIG. 5 as a shaded area, is accentuated, in which the light coming from the region of the filter 12 occurs.

FIG. 6 shows a further embodiment of a LED collimator element 1 according to the invention. Analogous to FIG. 2, the filter element 12 is arranged in the region of the edge 8, and is now intentionally arranged in such a way that the filter 12 projects from the edge 8. With this type of arrangement, the filter 12 (in addition to the stray light mentioned in the description of FIG. 2) now has desired scattering characteristics. A part of the light, which is incident upon the filter 12, can thus be deflected into the region behind the edge 8 and thence reach the secondary optical system. Since only a small part of the light is deflected in this way, the luminance beyond the edge 8 is correspondingly small and continues to decrease with an increasing distance. Therefore, in an image (analogous to FIG. 5), a soft bright-dark cut-off with a defined colored appearance would result on the road. Particularly in this case, the filter can be realized color-neutrally and only in a scattering version.

FIG. 7 shows a further embodiment of a LED collimator element 1 according to the invention. In the embodiment shown in FIG. 7, a filter 12 is provided in the region of low luminance in the proximity of the edge 9, which filter deflects the direction of the rays exiting there into the direction of the detection region of the secondary optical system. Without a filter 12 arranged in such a way, a major part of the radiation would most probably lie outside this detection region. Such a filter 12 can thus contribute to an increased efficiency of the lighting system.

The invention claimed is:

1. A LED collimator for a vehicle headlight, which emits light from at least one light source, wherein the at least one light source comprises at least one LED, wherein a part of the light is directly radiated in a radiation angular range of the LED collimator, wherein the LED collimator is configured to deflect the light which is not radiated in the radiation angular range of the LED collimator into the radiation angular range, wherein the LED collimator is asymmetrically structured at least regarding a collimator cutting plane in such a way that a non-uniform brightness distribution is achieved in a radiation plane of the LED collimator, wherein the radiation plane is defined orthogonally with respect to the collimator cutting plane and with respect to a main direction of radiation of the LED collimator element, wherein at least one wavelength-dependent filter is arranged in at least a portion of the radiation plane, wherein the non-uniform brightness distribution is arranged to form a high intensity light inside a first edge of the LED collimator and substantially no light intensity is formed at the outside of the first edge creating a bright-dark cut-off, wherein at least one scattering filter is arranged along a first edge of the LED collimator so that a portion of light reaches the region above the bright-dark cut-off.

2. A LED collimator as claimed in claim 1, wherein at least one of the at least one filter is arranged in such a way that the light from a region of high intensity has a different spectral composition than a light from regions of low intensity.

3. A LED collimator as claimed in claim 1, wherein the LED collimator comprises a first area of the LED collimator at which a first edge is formed which is less inclined with respect to the main direction of radiation than a second area.

4. A LED collimator as claimed in claim 1, further comprising a secondary optical system arranged to accept light from the radiation plane in the main direction of radiation.

5. A LED collimator as claimed in claim 1, wherein the at least on LED is an organic or an inorganic LED.

6. A LED collimator as claimed in claim 1, wherein the at least one LED is a plurality of LED elements having different characteristics.

7. A LED collimator as claimed in claim 1, wherein the at least one filter extends beyond of the LED collimator.

8. A LED collimator as claimed in claim 1, wherein the at least one filter serves as a point of reference in order to determine the geometrical position of the bright-dark cut-off relative to the mechanical references of the housing of the LED collimator.

9. An illumination unit having at least one LED collimator as claimed in claim 1.

10. A illumination unit as claimed in claim 9, wherein the traffic space below the bright-dark cut-off can be illuminated to provide a first region with unfiltered light and a second region of filtered light.

11. A LED collimator as claimed in claim 1, wherein the scattering filter emits yellow light.

12. A LED collimator for a vehicle headlight, which emits light from at least one light source, wherein the at least one light source comprises at least one LED, wherein a part of the light is directly radiated in a radiation angular range of the LED collimator, wherein the LED collimator is configured to deflect the light which is not radiated in the radiation angular range of the LED collimator into the radiation angular range, wherein the LED collimator is asymmetrically structured at least regarding a collimator cutting plane in such a way that a brightness distribution is achieved in a radiation plane of the LED collimator comprising a high luminance region and a low luminance region, wherein the radiation plane is defined orthogonally with respect to the collimator cutting plane and with respect to a main direction of radiation of the LED collimator element, wherein at least one filter is provided in the region of low luminance, wherein the filter deflects a portion of the rays exiting the LED collimator into the direction of the radiation angular range.

13. A LED collimator as claimed in claim 12, wherein at least one of the at least one filter is arranged in such a way that the light from a region of high intensity has a different spectral composition than a light from regions of low intensity.

14. A LED collimator as claimed in claim 12, wherein the LED collimator comprises a first area of the LED collimator at which a first edge is formed which is less inclined with respect to the main direction of radiation than a second area.

15. A LED collimator as claimed in claim 12, further comprising a secondary optical system arranged to accept light from the radiation plane in the main direction of radiation.

16. A LED collimator as claimed in claim 12, wherein the at least on LED is an organic or an inorganic LED.

17. A LED collimator as claimed in claim 12, wherein the at least one LED is a plurality of LED elements having different characteristics.

18. A LED collimator as claimed in claim 12, wherein the at least one filter extends beyond of the LED collimator.

19. A LED collimator as claimed in claim 12, wherein the at least one filter serves as a point of reference in order to determine the geometrical position of the bright-dark cut-off relative to the mechanical references of the housing of the LED collimator.

20. An illumination unit having at least one LED collimator as claimed in claim 12, wherein the traffic space below the bright-dark cut-off can be illuminated to provide a first region with unfiltered light and a second region of filtered light.

* * * * *